US008708761B2

(12) United States Patent
Suzuki

(10) Patent No.: US 8,708,761 B2
(45) Date of Patent: Apr. 29, 2014

(54) VESSEL PROPULSION APPARATUS

(75) Inventor: Atsushi Suzuki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 99 days.

(21) Appl. No.: 13/549,539

(22) Filed: Jul. 16, 2012

(65) Prior Publication Data

US 2013/0203309 A1 Aug. 8, 2013

(30) Foreign Application Priority Data

Feb. 8, 2012 (JP) ..... 2012-025114

(51) Int. Cl.
*B63H 21/32* (2006.01)

(52) U.S. Cl.
USPC ..... 440/89 C; 440/89 H; 440/89 R; 60/321

(58) Field of Classification Search
CPC ..... B63H 21/32; F01N 3/043; F01N 13/004; F01N 2590/021; F01N 13/12; F01N 3/046; F01N 13/102; F02B 61/045
USPC .... 440/89 B, 89 C, 89 F, 89 H, 89 R; 60/299, 60/317, 323, 324, 320, 321, 302
See application file for complete search history.

(56) References Cited

U.S. PATENT DOCUMENTS

| | | | | |
|---|---|---|---|---|
| 5,026,611 | A * | 6/1991 | Usui et al. | 428/593 |
| 6,368,726 | B1 * | 4/2002 | Holpp et al. | 428/593 |
| 7,651,755 | B2 * | 1/2010 | Yoshida | 428/116 |
| 7,698,889 | B1 | 4/2010 | Burk et al. | |
| 7,867,048 | B2 | 1/2011 | Ochiai | |
| 2006/0165567 | A1 | 7/2006 | Bruck et al. | |

FOREIGN PATENT DOCUMENTS

| | | |
|---|---|---|
| JP | 2004-143981 A | 5/2004 |
| JP | 2007-507649 A | 3/2007 |

* cited by examiner

*Primary Examiner* — Lars A Olson
(74) *Attorney, Agent, or Firm* — Keating & Bennett, LLP

(57) ABSTRACT

A vessel propulsion apparatus includes an exhaust passage guiding exhaust generated at an engine, a water jacket cooling at least a portion of the exhaust passage, a cooling device supplying water outside the vessel propulsion apparatus to the water jacket, an exhaust sensor detecting a concentration of a component in the exhaust in the exhaust passage, and a non-catalytic porous member disposed in the exhaust passage at an upstream side relative to the exhaust sensor. The non-catalytic porous member is a porous member that does not hold a catalyst.

9 Claims, 4 Drawing Sheets

VESSEL PROPULSION APPARATUS

BACKGROUND OF THE INVENTION

1. Field of the Invention

The present invention relates to a vessel propulsion apparatus.

2. Description of the Related Art

U.S. Pat. No. 7,867,048 B2 discloses an outboard motor with which an oxygen concentration inside an exhaust pipe is detected by an oxygen concentration sensor. U.S. Pat. No. 7,698,889 B2 discloses an exhaust system for a marine engine in which an oxygen concentration inside an exhaust pipe is detected by an oxygen concentration sensor. A catalyst that purifies the exhaust inside the exhaust pipe is disposed at an upstream side relative to the oxygen concentration sensor. A honeycomb member that captures water flowing in reverse inside the exhaust pipe toward a combustion chamber is disposed at a downstream side relative to the oxygen concentration sensor.

SUMMARY OF THE INVENTION

The inventor of preferred embodiments of the present invention described and claimed in the present application conducted an extensive study and research regarding a vessel propulsion apparatus, such as those described above, and in doing so, discovered and first recognized new unique challenges and previously unrecognized possibilities for improvements as described in greater detail below.

Specifically, when a temperature of an exhaust pipe is high, corrosion of metal due to water, such as seawater, occurs, and thus in a vessel propulsion apparatus, an exhaust pipe is cooled by cooling water of lower temperature than in an internal circulation type cooling device included in an automobile. However, an inner wall surface of the exhaust pipe is maintained at a low temperature and water (condensed water) forms readily inside the exhaust pipe.

The water that forms inside the exhaust pipe flows toward a downstream side together with exhaust. An exhaust sensor, such as an oxygen concentration sensor, is exposed to high-temperature exhaust and is thus high in temperature. When condensed water forms at an upstream side relative to the exhaust sensor, the condensed water attaches to the exhaust sensor at the high temperature and a thermal shock is applied to the exhaust sensor. Further, when condensed water that contains sulfur and other hazardous components in exhaust enters into an interior of the exhaust sensor, the exhaust sensor may degrade.

With U.S. Pat. No. 7,867,048 B2 and U.S. Pat. No. 7,698,889 B2, the catalyst is disposed at the upstream side relative to the oxygen concentration sensor. Condensed water that forms at the upstream side relative to the oxygen concentration sensor is captured by the catalyst. However, a catalyst is not necessarily provided in all exhaust systems and there are cases where a catalyst is not provided. In such a case, the condensed water cannot be captured by the catalyst and thus the condensed water becomes attached to the oxygen concentration sensor and performance of the sensor is thereby lowered.

In order to overcome the previously unrecognized and unsolved challenges described above, a preferred embodiment of the present invention provides a vessel propulsion apparatus that includes an engine, an exhaust passage, a water jacket, a cooling device, an exhaust sensor, and a non-catalytic porous member that does not hold a catalyst. Exhaust generated by the engine is guided by the exhaust passage. The water jacket cools at least a portion of the exhaust passage. The cooling device supplies water outside the vessel propulsion apparatus to the water jacket. At least a portion of the exhaust sensor is disposed in the exhaust passage. The exhaust sensor detects a concentration of a component in the exhaust. The non-catalytic porous member is disposed in the exhaust passage at an upstream side relative to the exhaust sensor.

With this arrangement of the present preferred embodiment of the present invention, water outside the vessel propulsion apparatus, that is, cooling water of low temperature is supplied to the water jacket by the cooling device. The exhaust passage is thereby cooled. Further, the non-catalytic porous member that does not hold a catalyst is disposed at the upstream side relative to the exhaust sensor and thus condensed water formed at the upstream side relative to the non-catalytic porous member passes through the non-catalytic porous member and is thereby dispersed by the non-catalytic porous member. The non-catalytic porous member can thus reduce the amount of water that moves toward the exhaust sensor. Further, the non-catalytic porous member is heated by the high-temperature exhaust and condensed water attached to the non-catalytic porous member evaporates. The non-catalytic porous member can thus protect the exhaust sensor from water flowing to the downstream side. Wetting (exposure to water) of the exhaust sensor can thus be prevented. Further, the non-catalytic porous member is less expensive than a catalytic converter that includes a catalyst and a carrier and the vessel propulsion apparatus can thus be minimized in manufacturing cost.

The non-catalytic porous member may include a honeycomb structure that allows a fluid to pass through from an upstream side to a downstream side of the exhaust passage. In this case, the honeycomb structure may be made of metal or made of ceramic, for example. The honeycomb structure includes a partitioning wall extending in a direction through which exhaust flows inside the exhaust passage and partitioning an interior of the honeycomb structure into a plurality of cells. Each cell is not limited to a hexagonal shape and may be of another polygonal shape, such as triangular, rectangular, or may be circular or may be of a shape besides the above.

The vessel propulsion apparatus may further include a catalytic converter disposed in the exhaust passage at a downstream side relative to the exhaust sensor. The catalytic converter includes a catalyst that purifies the exhaust and a carrier that holds the catalyst.

With this arrangement of the present preferred embodiment of the present invention, the exhaust inside the exhaust passage is purified by the catalytic converter. The catalytic converter is disposed at the downstream side relative to the exhaust sensor. The non-catalytic porous member is thus disposed at the upstream side relative to the catalytic converter. Exhaust that has passed through the porous member thus passes through the catalytic converter. When exhaust containing sulfur and other hazardous substances passes through the catalytic converter, the catalytic converter becomes readily degradable. Further, when a position of the catalytic converter at which the exhaust passes through is biased, localized degradation of the catalytic converter or lowering of exhaust purification efficiency occurs. Sulfur and other hazardous components contained in the exhaust are lessened by passage through the non-catalytic porous member. Degradation of the catalytic converter can thus be prevented. Further, the exhaust is flow-rectified by passage through the non-catalytic porous member. Biasing of the position of passage of the exhaust is thus reduced. Localized degradation of the catalytic converter and lowering of purification efficiency can thus be prevented. Further, when the exhaust passes through the non-catalytic porous member, the exhaust decreases in temperature and thus degradation of the catalytic converter due to heat can be prevented.

Also, the exhaust passage may include an upward guiding portion which extends upward toward the downstream side and in which the non-catalytic porous member is disposed.

With this arrangement of the present preferred embodiment of the present invention, the non-catalytic porous member is disposed in the upward guiding portion that extends upward toward the downstream side and the exhaust sensor is disposed at the downstream side relative to the non-catalytic porous member and thus the exhaust sensor is disposed at a position besides that below the non-catalytic porous member. Thus, even if water attached to the non-catalytic porous member drops, the water does not hit the exhaust sensor. The exhaust sensor can thus be protected from water flowing toward the downstream side.

Also, the exhaust passage may further include, in addition to the upward guiding portion, a downward guiding portion disposed at the downstream side relative to the upward guiding portion, extending downward toward the downstream side, and in which the exhaust sensor is disposed.

With this arrangement of the present preferred embodiment of the present invention, the non-catalytic porous member is disposed in the upward guiding portion that extends upward toward the downstream side and the exhaust sensor is disposed in the downward guiding portion extending downward toward the downstream side. The downward guiding member is disposed at the downstream side relative to the upward guiding portion. Thus, at least one top portion (for example, a frontward guiding portion) is disposed between the upward guiding portion and the downward guiding portion and condensed water flowing toward the downstream side from the non-catalytic porous member thus cannot reach the exhaust sensor unless it passes over the top portion. Water flowing to the downstream side is thus less likely to reach the exhaust sensor. Water flowing to the downstream side can thus be prevented more reliably from attaching to the exhaust sensor.

Also, the vessel propulsion apparatus may further include an engine cover covering the engine and the exhaust passage. In this case, the entire engine may be disposed in an internal space of the engine cover. Likewise, the entire non-catalytic porous member and exhaust sensor may be disposed in the internal space of the engine cover.

The engine may perform lean burn combustion based on a detection value of the exhaust sensor. That is, the engine may be a lean burn engine (internal combustion engine) that performs lean burn combustion based on the detection value of the exhaust sensor. In this case, a controller (for example, an ECU) that controls an engine state based on the detection value of the exhaust sensor to supply a mixed gas that is more dilute than a theoretical air fuel ratio to the combustion chamber may be included.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
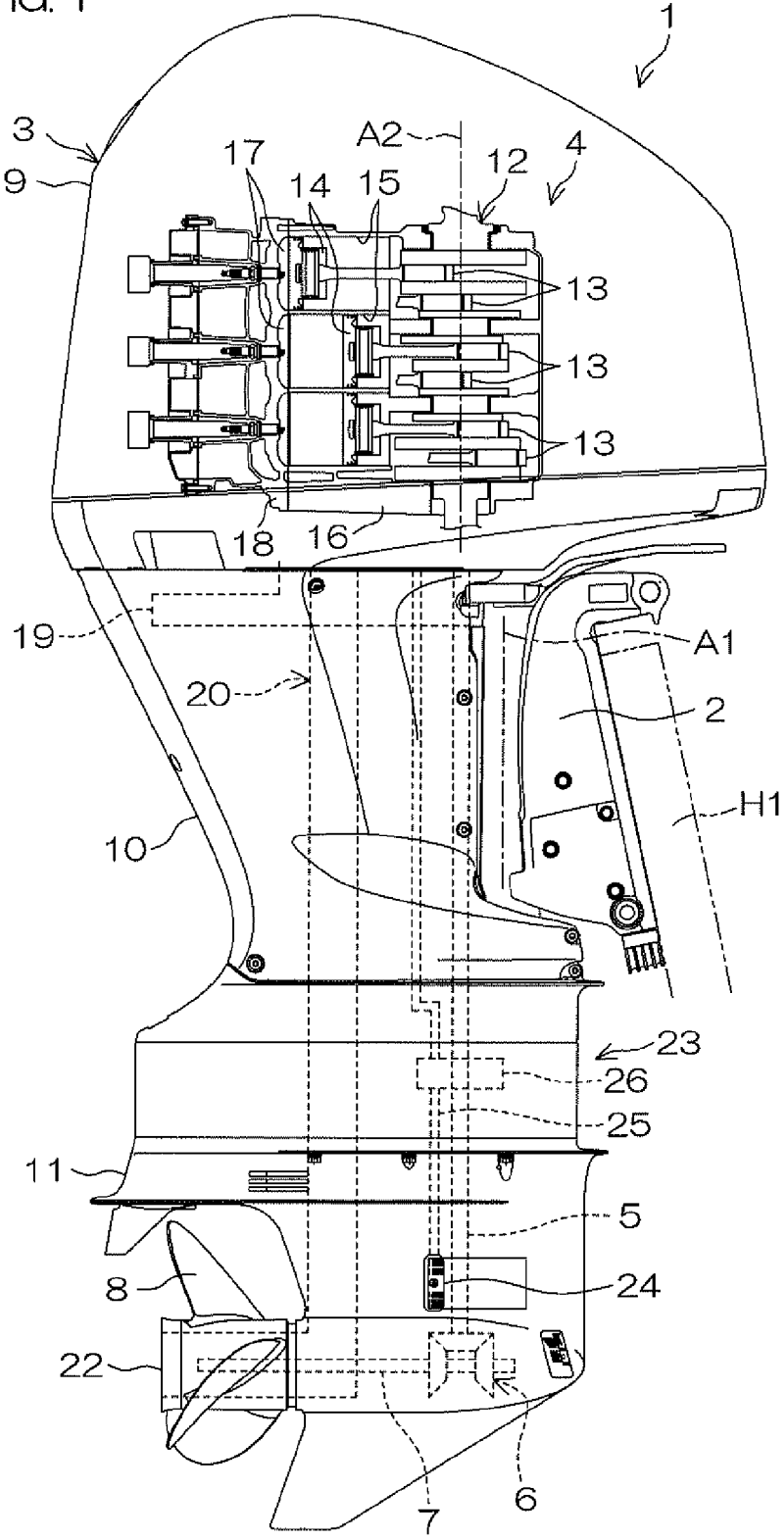
FIG. 1 is a side view of a vessel propulsion apparatus according to a preferred embodiment of the present invention.

FIG. 1 is a side view of a vessel propulsion apparatus 1 according to a preferred embodiment of the present invention. To facilitate understanding, FIG. 1 shows an interior of an engine cover 9 in a see-through manner.

The vessel propulsion apparatus 1 includes a bracket 2 attachable to a rear portion of a hull H1 and an outboard motor 3 supported by the bracket 2 in a manner enabling rotation around a steering axis A1 extending in a vertical direction.

The outboard motor 3 includes an engine 4, a driveshaft 5, a forward-reverse switching mechanism 6, and a propeller shaft 7. The outboard motor 3 further includes the engine cover 9 housing the engine 4, an upper casing 10 disposed below the engine cover 9, and a lower casing 11 disposed below the upper casing 10. The driveshaft 5 extends downward from the engine 4, and a lower end portion of the driveshaft 5 is coupled to a front end portion of the propeller shaft 7 via the forward-reverse switching mechanism 6. The propeller shaft 7 extends in a front/rear direction inside the lower casing 11. A rear end portion of the propeller shaft 7 protrudes rearward from the lower casing 11. A propeller 8 is coupled to the rear end portion of the propeller shaft 7. The propeller 8 is disposed in the water.

The engine 4 is an internal combustion engine. The engine 4 is preferably a multi-cylinder engine, or the engine 4 may be a single-cylinder engine. The engine 4 includes a crankshaft 12 rotatable around a crank axis A2 extending in the vertical direction, a plurality of connecting rods 13 coupled to the crankshaft 12, and a plurality of pistons 14 respectively coupled to the plurality of connecting rods 13. Further, the engine 4 includes a cylinder body 16 that includes a plurality of cylinders 15, and a cylinder head 18 that includes a plurality of combustion chambers 17. An upper end portion of the driveshaft 5 is coupled to a lower end portion of the crankshaft 12.

The engine 4 rotates the crankshaft 12 in a fixed rotation direction. The rotation of the engine 4 (rotation of the crankshaft 12) is transmitted to the propeller 8 by the driveshaft 5, the forward-reverse switching mechanism 6, and the propeller shaft 7. A rotation direction of the propeller 8 is switched between a forward drive direction (for example, a clockwise direction as viewed from the rear of the propeller 8) and a reverse drive direction (the direction opposite the forward drive direction) by the forward-reverse switching mechanism 6. That is, when a vessel operator performs a shift operation, the forward-reverse switching mechanism 6 transmits the rotation from the driveshaft 5 to the propeller shaft 7 so that the rotation direction of the propeller shaft 7 is reversed. The rotation direction of the propeller 8 is thereby switched.

The outboard motor 3 further includes an exhaust guide 19 that supports the engine 4. The exhaust guide 19 is disposed below the engine 4 in the outboard motor 3. Due to the arrangement of the exhaust guide 19, the engine 4 is supported and exhaust generated in the combustion chambers 17 is guided downward. That is, the outboard motor 3 includes a main exhaust passage 20 by which the exhaust generated in the combustion chambers 17 is guided to the propeller 8. The exhaust guide 19 defines a portion of the main exhaust passage 20. The main exhaust passage 20 includes a plurality of exhaust ports 21 (see FIG. 2) as exhaust inlets into which the exhaust generated in the plurality of combustion chambers 17 flow and an exhaust outlet 22 that opens at a boss portion of the propeller 8. The exhaust generated in the plurality of combustion chambers 17 flows from the plurality of exhaust ports 21 into the main exhaust passage 20. When an exhaust pressure inside the main exhaust passage 20 increases, the exhaust inside the main exhaust passage 20 is discharged underwater from the exhaust outlet 22.

The outboard motor 3 further includes a cooling device 23 that supplies cooling water to a water jacket Wj (see FIG. 2) provided in an internal arrangement of the outboard motor 3, including in the engine 4, etc. The cooling device 23 includes a water intake port 24 opening at an outer surface of the outboard motor 3 (outer surface of the lower casing 11), a water supply passage 25 connecting the water intake port 24 and the water jacket Wj, and a water pump 26 disposed on the water supply passage 25. The water pump 26 is coupled to the driveshaft 5. When the engine 4 rotates, water outside the outboard motor 3 is supplied as cooling water to the water jacket Wj by the water pump 26. Water that has passed through the water jacket Wj is discharged outside the outboard motor 3. The internal arrangement of the outboard motor 3, including the engine 4, etc., is thereby cooled. The cooling device 23 supplies water outside the outboard motor 3, that is, sea, lake, or river water to the interior of the outboard motor 3 and can thus more surely supply cooling water having a low temperature to the outboard motor 3 than an internal circulation type cooling device provided in an automobile. The outboard motor 3 is thus more surely maintained at a low temperature.

Figure 2A:
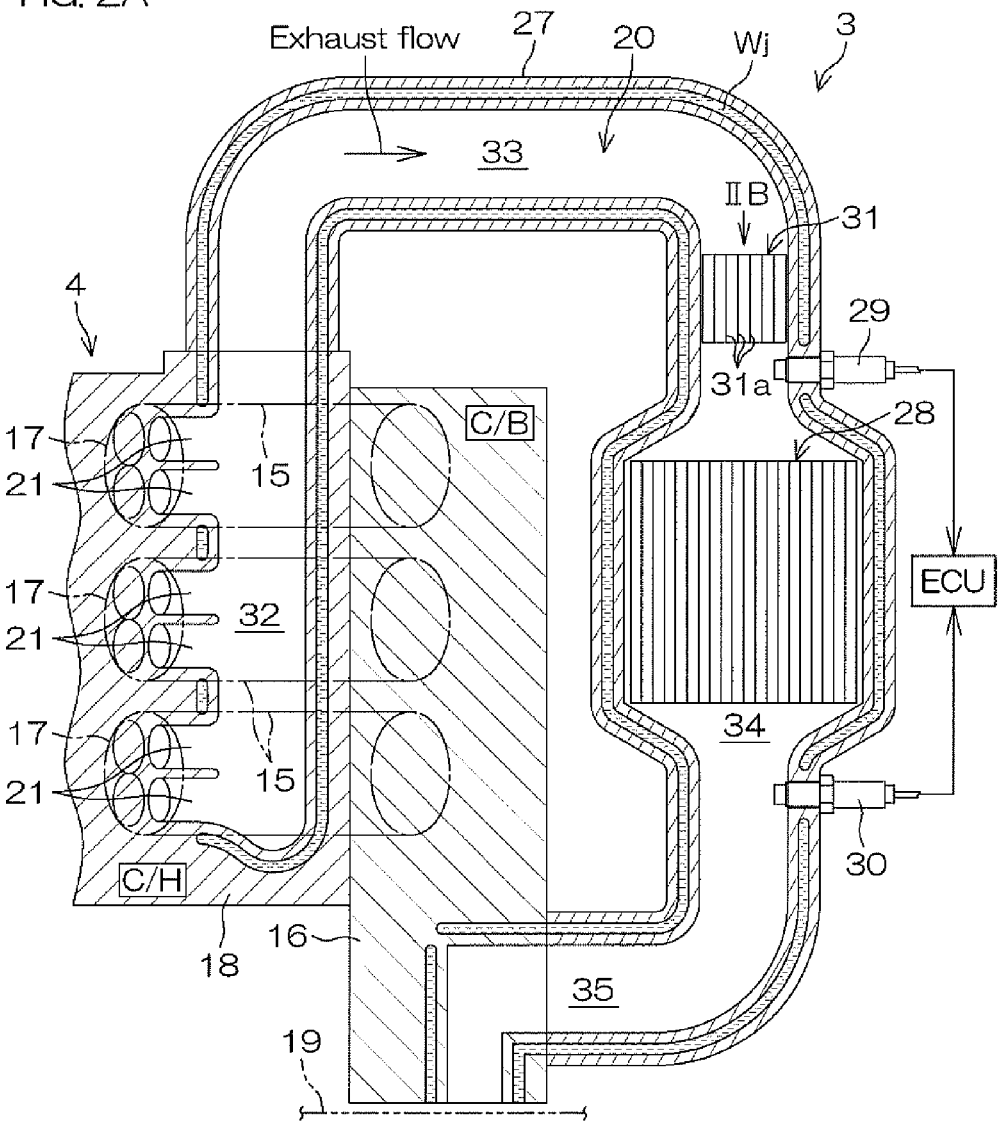
FIG. 2A is a schematic view of a portion of a main exhaust passage that guides exhaust from combustion chambers into an interior of the exhaust guide.
Figure 2B:
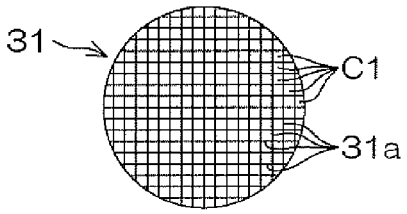
FIG. 2B is a diagram of a non-catalytic porous member as viewed from an arrow IIB shown in FIG. 2A.

FIG. 2A is a schematic view of a portion of the main exhaust passage 20 that guides the exhaust from the combustion chambers 17 into an interior of the exhaust guide 19. FIG. 2B is a diagram of a non-catalytic porous member 31 as viewed from an arrow IIB shown in FIG. 2A. FIG. 2A shall be referenced in the following description. FIG. 2B shall be referenced where suitable.

The outboard motor 3 includes an exhaust pipe 27 attached to the engine 4 and a catalytic converter 28 disposed inside the exhaust pipe 27. An upstream end and a downstream end of the exhaust pipe 27 are attached to the cylinder head 18 and the cylinder body 16, respectively. The exhaust pipe 27 may be a single pipe or may include a plurality of pipes. An internal space of the exhaust pipe 27 is partitioned into an upstream side and a downstream side by the catalytic converter 28. The catalytic converter 28 preferably is, for example, a three-way catalyst. The catalytic converter 28 includes a honeycomb-shaped carrier with an interior partitioned into a plurality of cells by partitioning walls extending in a direction through which the exhaust flows and a catalyst held by the carrier. All of the exhaust guided into the exhaust pipe 27 passes through the catalytic converter 28. The exhaust is thereby purified.

The outboard motor 3 further includes an upstream sensor 29 and a downstream sensor 30 attached to the exhaust pipe 27. The upstream sensor 29 is attached to the exhaust pipe 27 at an upstream side relative to the catalytic converter 28 in the exhaust flow direction, and the downstream sensor 30 is attached to the exhaust pipe 27 at a downstream side relative to the catalytic converter 28 in the exhaust flow direction. A portion of each of the upstream sensor 29 and the downstream sensor 30 is disposed inside the exhaust pipe 27. The upstream sensor 29 and the downstream sensor 30 are oxygen concentration sensors that contain a ceramic (for example, zirconia). The upstream sensor 29 and the downstream sensor 30 may be air-fuel ratio sensors. Oxygen concentration sensors and air-fuel ratio sensors are examples of exhaust sensors that detect a concentration of a component contained in the exhaust. Detection values of the upstream sensor 29 and the downstream sensor 30 are input into an ECU (electronic control unit) that controls the engine 4. The ECU adjusts a fuel injection amount of a fuel injection device, etc., based on the detection values from the upstream sensor 29 and the downstream sensor 30.

The outboard motor 3 further includes the non-catalytic porous member 31 that does not hold a catalyst. The non-catalytic porous member 31 is disposed inside the exhaust pipe 27 at an upstream side relative to the upstream sensor 29 in the exhaust flow direction. The internal space of the exhaust pipe 27 is partitioned into an upstream side and a downstream side by the non-catalytic porous member 31. All of the exhaust guided into the exhaust pipe 27 passes through the non-catalytic porous member 31 from the upstream side to the downstream side. The non-catalytic porous member 31 is a porous member with which numerous fine pores extending in the exhaust flow direction are provided. That is, the non-catalytic porous member 31 preferably is a honeycomb structure. The honeycomb structure may be made of metal or made of ceramic, for example. The honeycomb structure includes partitioning walls 31*a* extending in the exhaust flow direction. As shown in FIG. 2B, the partitioning walls 31*a* partition an interior of the honeycomb structure into a plurality of cells C1. Each cell C1 is not limited to a hexagonal shape and may be of another polygonal shape, such as triangular, rectangular, or may be circular or may be of a shape besides the shapes listed above.

The main exhaust passage 20 includes an upward guiding portion 32 connected to the plurality of combustion chambers 17 and a frontward guiding portion 33 extending to the front (to the right in FIG. 2A) from a downstream end of the upward guiding portion 32. Further, the main exhaust passage 20 includes a downward guiding portion 34 extending downward from the downstream end of the frontward guiding portion 33 and a rearward guiding portion 35 extending to the rear (to the left in FIG. 2A) from the downstream end of the downward guiding portion 34. The upward guiding portion 32 is defined by the cylinder head 18 and the exhaust pipe 27 and the frontward guiding portion 33 is defined by the exhaust pipe 27. The downward guiding portion 34 is defined by the exhaust pipe 27 and the rearward guiding portion 35 is defined by the exhaust pipe 27 and the cylinder body 16. The guiding portions 32 to 35 are disposed inside the engine cover 9 (see FIG. 1). The water jacket Wj is disposed along the respective guiding portions 32 to 35. Inner wall surfaces of the respective guiding portions 32 to 35 are thus heated by the exhaust and cooled by the cooling water.

The upward guiding portion 32 extends upward from the respective exhaust ports 21. The plurality of exhaust ports 21 are respectively disposed at different heights. The uppermost exhaust port 21 is disposed below an upper end (downstream end) of the upward guiding portion 32. The lowermost exhaust port 21 is disposed above a lower end of the upward guiding portion 32. Likewise, the lowermost combustion chamber 17 and cylinder 15 are also disposed above the lower end of the upward guiding portion 32. The frontward guiding portion 33 extends frontward from an upper end portion of the upward guiding portion 32 and the downward guiding portion 34 extends downward from a front end portion of the frontward guiding portion 33. The rearward guiding portion 35 extends rearward from a lower end portion of the downward guiding portion 34. The non-catalytic porous member 31, the upstream sensor 29, the catalytic converter 28, and the downstream sensor 30 are disposed in the downward guiding portion 34 in a state of being aligned in that order from the upstream side.

The exhaust discharged from the respective exhaust ports 21 collect at the upward guiding portion 32 and are guided upward by the upward guiding portion 32. Thereafter, the exhaust is guided frontward by the frontward guiding portion 33 and then guided downward by the downward guiding portion 34. The exhaust thus passes through the non-catalytic porous member 31 from above to below and thereafter passes through the catalytic converter 28 from above to below. The exhaust guided downward by the downward guiding portion 34 is guided rearward by the rearward guiding portion 35. The rearward guiding portion 35 is connected to the internal space of the exhaust guide 19 (a portion of the main exhaust passage 20). The exhaust discharged from the rearward guiding portion 35 thus flows into the internal space of the exhaust guide 19. Exhaust generated at the combustion chambers 17 is thus discharged from the cylinder head 18 to the exhaust pipe 27 and returned from the exhaust pipe 27 to the cylinder body 16.

As described above, with the present preferred embodiment, the non-catalytic porous member 31 that does not hold a catalyst is disposed at the upstream side relative to the upstream sensor 29, which is an example of an exhaust sensor, and thus even if moisture contained in the exhaust condenses and condensed water forms, the condensed water is dispersed by passage through the non-catalytic porous member 31. The non-catalytic porous member 31 can thus reduce the amount of water moving toward the upstream sensor 29. Further, the non-catalytic porous member 31 is heated by the high temperature exhaust and the condensed water attached to the non-catalytic porous member 31 thus evaporates. The non-catalytic porous member can thus protect the upstream sensor 29 from water flowing to the downstream side. Wetting (exposure to water) of the upstream sensor 29 can thus be prevented. Further, the non-catalytic porous member 31 is less expensive than the catalytic converter 28 that includes the catalyst and thus, the manufacturing costs of the carrier and the vessel propulsion apparatus 1 can be minimized.

Further, with the present preferred embodiment, the non-catalytic porous member 31 is disposed at the upstream side relative to the catalytic converter 28 and thus the exhaust that has passed through the non-catalytic porous member 31 passes through the catalytic converter 28. When exhaust containing sulfur and other hazardous substances pass through the catalytic converter 28, the catalytic converter 28 becomes readily degradable. Further, when a position of the catalytic converter 28 at which the exhaust passes through is biased, localized degradation of the catalytic converter 28 or lowering of exhaust purification efficiency occurs. Sulfur and other hazardous components contained in the exhaust are reduced by passage through the non-catalytic porous member 31. Degradation of the catalytic converter 28 can thus be prevented. Further, the flow of the exhaust is rectified by passage through the non-catalytic porous member 31. Biasing of the position of passage of the exhaust is thus reduced. Localized degradation of the catalytic converter 28 and lowering of purification efficiency can thus be prevented. Further, when the exhaust passes through the non-catalytic porous member 31, the exhaust decreases in temperature and thus degradation of the catalytic converter 28 due to heat can be prevented.

Further, with the present preferred embodiment, the non-catalytic porous member 31 and the upstream sensor 29 are disposed in a guiding portion in common (the downward guiding portion 34). A flow passage length from the non-catalytic porous member 31 to the upstream sensor 29 is thus short and the amount of condensed water that forms between the non-catalytic porous member 31 and the upstream sensor 29 is low. Condensed water formed between the non-catalytic porous member 31 and the upstream sensor 29 can thus be prevented from attaching to the upstream sensor 29. The upstream sensor 29 can thereby be protected more reliably from water flowing to the downstream side.

Although a preferred embodiment of the present invention has been described above, the present invention is not restricted to the contents of the above-described preferred embodiment and various modifications are possible within the scope of the claims.

Figure 3:
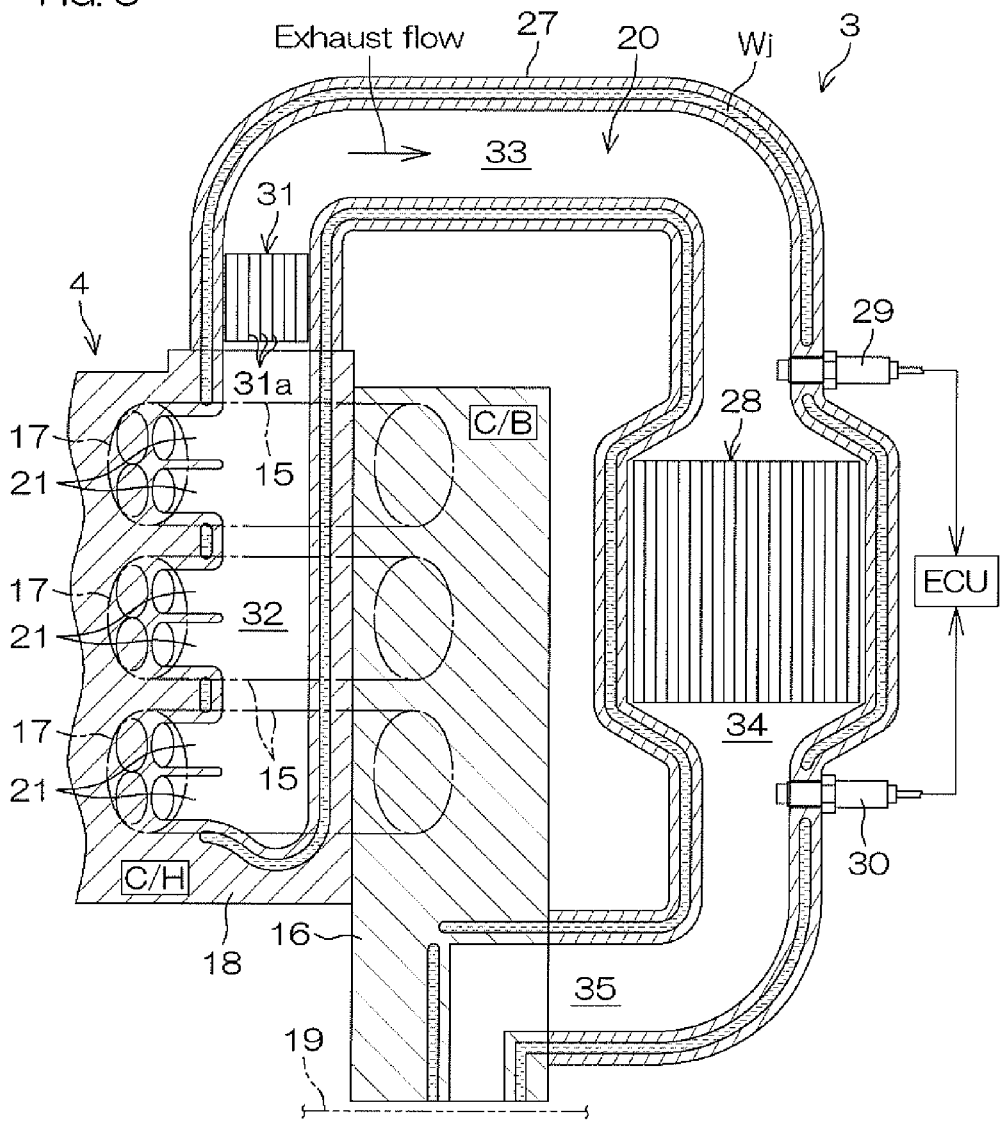
FIG. 3 is a schematic view of a portion of a main exhaust passage according to another preferred embodiment of the present invention.

For example, with the preferred embodiment described above, a case where the upstream sensor 29 that is an example of an exhaust sensor is disposed in the downward guiding portion 34 was described. However, the upstream sensor 29 may be disposed in any of the guiding portions 32, 33, and 35 besides the downward guiding portion 34. In this case, the non-catalytic porous member 31 may be disposed in any of the guiding portions as long as it is disposed at a position that is at the upstream side relative to the upstream sensor 29. That is, the non-catalytic porous member 31 may be disposed in a guiding portion in common with the upstream sensor 29 or may be disposed in a guiding portion different from the upstream sensor 29. For example, as shown in FIG. 3, the upstream sensor 29 may be disposed in the downward guiding portion 34 and the non-catalytic porous member 31 may be disposed in the upward guiding portion 32. In this case, the non-catalytic porous member 31 may be disposed inside the exhaust pipe 27 or may be disposed inside the cylinder head 18.

Figure 4:
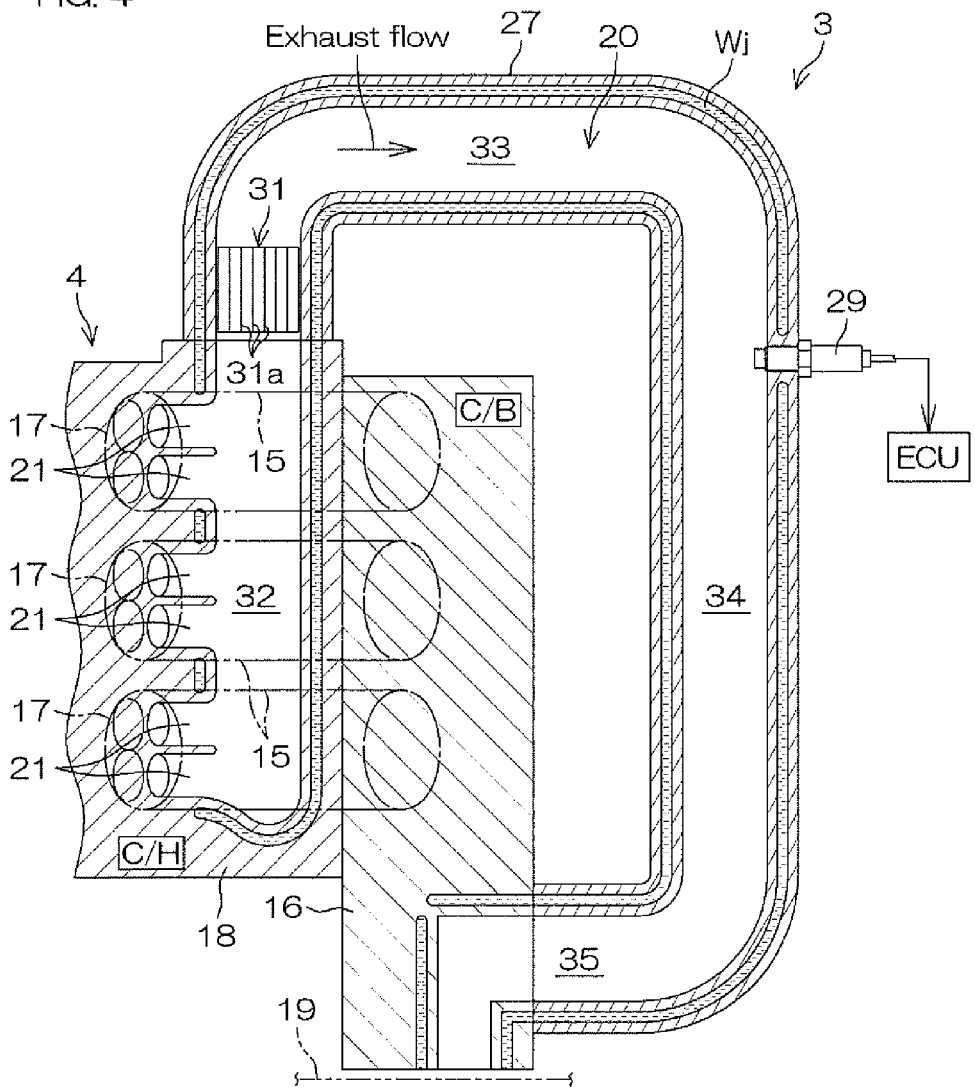
FIG. 4 is a schematic view of a portion of a main exhaust passage according to yet another preferred embodiment of the present invention.

Also, with the preferred embodiment described above, a case where the catalytic converter 28 is disposed in the main exhaust passage 20 was described. However, as shown in FIG. 4, the catalytic converter 28 does not have to be disposed in the main exhaust passage 20. That is, the engine 4 may be a lean burn engine that performs lean burn combustion based on a detection value of the upstream sensor 29. Specifically, the ECU may operate the engine 4 with a mixed gas that is more dilute than a theoretical air fuel ratio by adjusting a fuel injection amount of a fuel injection device or an opening degree of a throttle valve that adjusts an air intake amount supplied to the combustion chambers 17 based on the detection value of the upstream sensor 29.

Also, with the preferred embodiment described above, a case where the vessel propulsion apparatus 1 includes the outboard motor 3 and the main exhaust passage 20 is disposed outside the vessel (outside the hull H1) was described. However, the vessel propulsion apparatus 1 may be an inboard motor or an inboard/outboard motor and at least a portion of the main exhaust passage 20 may be disposed inside the vessel. The upstream sensor 29 and the non-catalytic porous member 31 are thus not restricted to being disposed outside the vessel and may be disposed inside the vessel instead.

The present application corresponds to Japanese Patent Application No. 2012-025114 filed on Feb. 8, 2012 in the Japan Patent Office, the entire disclosure of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion apparatus comprising:

an engine;

an exhaust passage that guides exhaust generated by the engine;

a water jacket that cools at least a portion of the exhaust passage;

a cooling device that supplies water from outside the vessel propulsion apparatus to the water jacket;

an exhaust sensor that detects a concentration of a component in the exhaust and includes a portion disposed in the exhaust passage; and a non-catalytic porous member that does not contain a catalyst and is disposed in the exhaust passage at an upstream side relative to the exhaust sensor.

2. The vessel propulsion apparatus according to claim 1, wherein the non-catalytic porous member includes a honeycomb structure that allows a fluid to pass through from an upstream side of the exhaust passage to a downstream side of the exhaust passage.

3. The vessel propulsion apparatus according to claim 2, wherein the honeycomb structure is made of metal.

4. The vessel propulsion apparatus according to claim 2, wherein the honeycomb structure is made of ceramic.

5. The vessel propulsion apparatus according to claim 1, further comprising a catalytic converter disposed in the exhaust passage at a downstream side relative to the exhaust sensor.

6. The vessel propulsion apparatus according to claim 1, wherein the exhaust passage includes an upward guiding portion extending upward toward a downstream side of the exhaust passage, and in which the non-catalytic porous member is disposed.

7. The vessel propulsion apparatus according to claim 6, wherein the exhaust passage further includes a downward guiding portion disposed downstream relative to the upward guiding portion, extending downward toward the downstream side of the exhaust passage, and in which the exhaust sensor is disposed.

8. The vessel propulsion apparatus according to claim 1, further comprising an engine cover covering the engine and the exhaust passage.

9. The vessel propulsion apparatus according to claim 1, wherein the engine performs lean burn combustion based on a detection value of the exhaust sensor.

* * * * *